United States Patent [19]

Inoue et al.

[11] 4,351,995

[45] Sep. 28, 1982

[54] VIBRATION-PREVENTING MECHANISM FOR USE IN A PUSH BUTTON SWITCH

[75] Inventors: Akihiko Inoue; Takeo Ito, both of Soma, Japan

[73] Assignee: Alps Electric Company, Ltd., Tokyo, Japan

[21] Appl. No.: 184,284

[22] Filed: Sep. 5, 1980

[30] Foreign Application Priority Data

Sep. 8, 1979 [JP] Japan ..... 54/124338[U]

[51] Int. Cl.[3] ..... H01H 3/12; H01H 13/66

[52] U.S. Cl. ..... 200/159 A; 200/5 E; 200/283; 200/339; 200/340

[58] Field of Search ..... 200/159 A, 283, 288, 200/301, 338, 339, 340, 5 C, 5 D, 5 E

[56] References Cited

U.S. PATENT DOCUMENTS

| | | | |
|---|---|---|---|
| 734,793 | 7/1903 | Alexander | 200/159 A X |
| 1,308,711 | 7/1919 | Harlow | 200/159 A |
| 3,126,466 | 3/1964 | Schwartz | 200/283 X |
| 3,250,882 | 5/1966 | Campbell et al. | 200/159 A X |
| 3,576,958 | 3/1971 | Ohno | 200/339 X |
| 3,657,460 | 4/1972 | Cutler | 200/288 X |
| 3,749,872 | 7/1973 | Foster | 200/159 A X |
| 3,970,806 | 7/1976 | Distler | 200/5 E X |
| 4,017,700 | 4/1977 | West | 200/159 A X |

FOREIGN PATENT DOCUMENTS 861044 1/1971 Canada .

*Primary Examiner*—William Price
*Assistant Examiner*—Gary E. Elkins
*Attorney, Agent, or Firm*—Guy W. Shoup; Gerard F. Dunne

[57] ABSTRACT

A vibration-preventing mechanism for a lock type push button switch eliminates vibration, chattering and vibration noise of a resilient spring contact by forming a projection on each push button.

3 Claims, 6 Drawing Figures

VIBRATION-PREVENTING MECHANISM FOR USE IN A PUSH BUTTON SWITCH

BACKGROUND OF THE INVENTION

The present invention relates to a vibration-preventing mechanism and more specifically to a vibration-preventing mechanism for preventing vibration of a resilient contact in a lock type push button switch.

Lock type push button switch devices generally include a plurality of push buttons, resilient contacts having spring quality and disposed so as to correspond to the push buttons and a leaf spring engaging each push button and urging it in the direction opposite the depressing direction. A lock mechanism for holding the push button in the depressed state until another push button is depressed is often provided. In the push button device of this kind, when a given push button is depressed against the spring force of the leaf spring thereby to deform a resilient contact to actuate the switch, the lock mechanism continuously holds the push button in its depressed, i.e. latched, state. When another push button is depressed, any previously latched push button is released, whereupon the push button thus released returns to its non-depressed state and, at the same time, the resilient contact also returns to its initial state to disengage the switch. The depressed push button is in turn latched, thereby actuating the switch corresponding thereto.

In the lock type push button device of the above-described kind, when the push button returns to its non-depressed position, the resilient contact attempts to also return to its initial state due to its own resiliency and follows the return of the push button. Since the contact has a considerable magnitude of resiliency, it often passes its initial state and thereafter tends to return again to the initial, un-stressed state. However, the contact may again pass beyond the initial position due to its resiliency. Thereafter, while repeating this operation, the contact gradually reduces its range of motion and finally comes to rest at the initial position. In other words, the contact may vibrate due to its spring quality. Vibration of the contact results in wear of the contact portion due to chattering, and occurrence of an offensive noise to the operator, or erroneous operation of the switch may result.

Accordingly, it is desired to remove the vibration of the contact in the push button device.

SUMMARY OF THE INVENTION

The primary object of the present invention is to provide a vibration-preventing mechanism for a lock type push button device, said mechanism having a simple construction and yet capable of removing vibration of the contact.

DETAILED DESCRIPTION OF THE PREFERRED EMBODIMENT

Figure 1:
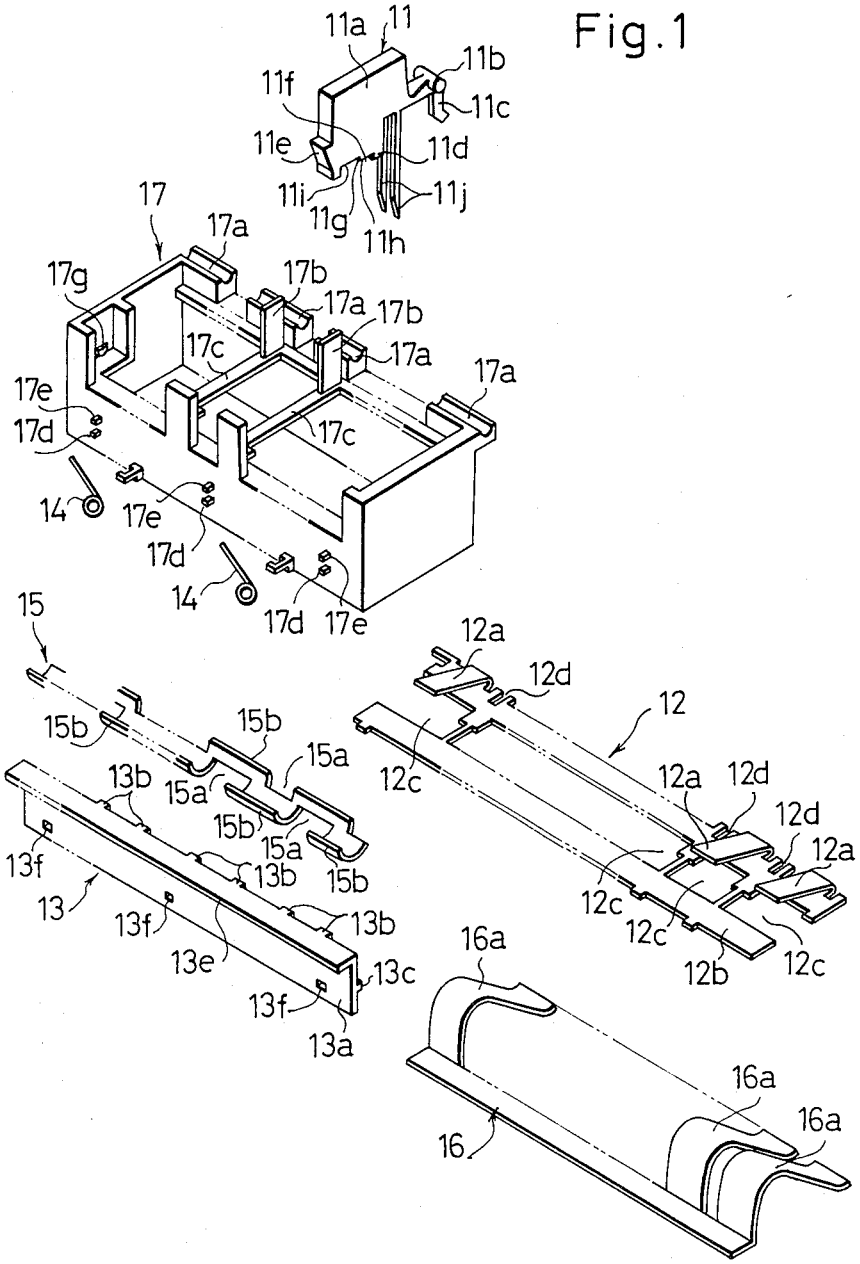
FIG. 1 is an exploded perspective view of the push button device in accordance with the present invention.
Figure 2:
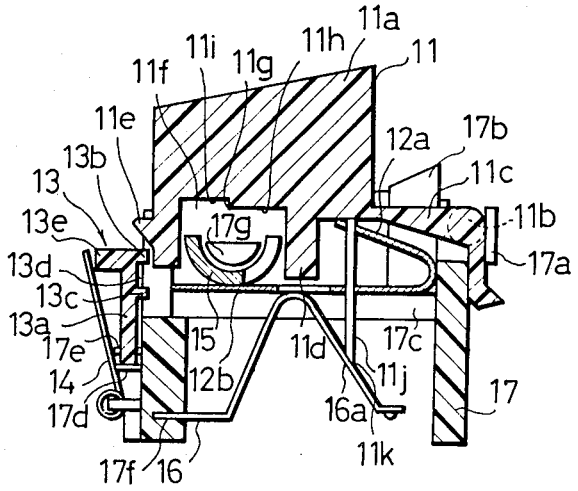
FIG. 2 is a sectional view of the push button device.

Referring initially to FIGS. 1 and 2 that are an exploded perspective view and a sectional view of the push button device of the present invention, respectively, reference numeral 11 denotes a push button made of a plastic material, which consists of an operation portion 11*a*, a generally L-shaped member 11*c* extending outwardly in an inverted manner from the rear surface of the operation portion 11*a* and having a shaft portion 11*b* which serves as a shaft for pivoting the operation portion 11*a*, a contact depressing projection 11*d* extending from the bottom of the operation portion 11*a* and which depresses the contact 16, a cam engaging projection 11*e* extending outwardly from the lower portion of the front surface of the operation portion 11*a* and which urges a cam plate away from the push button when it is depressed, as will be set forth more fully below. A recessed portion 11*f* is formed by the contact depressing projection 11*d*, the bottom of the operation portion 11*a* and the cam engaging projection 11*e*. Further, the bottom of the recessed portion 11*f* is formed with a protruded surface 11*h* and a recessed surface 11*i* defined by a step 11*g* therebetween, and on the bottom of the operation portion 11*a* is formed a projection 11*j* for preventing vibration.

Reference numeral 12 denotes a leaf spring made of a metal and having spring elements 12*a* formed in a V-shape, a base plate portion 12*b*, holes 12*c* which are formed in the base plate portion 12*b* and through which the contact depressing projections 11*d* of the push buttons 11 can penetrate. Notches 12*d* are provided for mounting the leaf spring on the frame, and these notches corresponded to the push buttons 11. The spring portions 12*a* come into contact with the under side of the L-shaped member 11*c* during depression of the push button 11 to energize the corresponding push button 11 in a direction opposite to the depressing direction.

Reference numeral 13 denotes a generally L-shaped cam plate which is commonly provided for the push buttons. On one side of a base plate 13*a* of the cam plate are formed engagement projections 13*b* which correspond to the push buttons 11, and a continuously formed projection 13*c*. Recessed areas 13*d* are defined between the engagement projections 13*b* and the continuously formed projection 13*c*. At the top portion of the base plate 13*a* on the side opposite the engagement projections 13*b* is formed a continuously protruded rail 13*e* extending outwards orthogonally from the base plate 13*a*. Further, holes 13*f* for mounting the cam plate to the frame 17 are formed in the lower portion at respective ends and the center of the base plate 13*a*. When any push button 11 is depressed, the engagement projection 13*b* lying oppositely thereto is depressed by the cam engaging projection 11*e*, whereby the cam plate 13 starts to rotate in the counterclockwise direction as shown in FIG. 2. As the push button 11 is further depressed, the cam engaging projection 11*e* moves within the recessed portion 13*d* and is held beneath the engagement projection 13*b*. The push button 11 therefore is locked or latched in a depressed state.

Reference numeral 14 denotes coil springs attached to the frame 17. The coil springs 14 engage the rail 13*e* of the cam plate 13 and urge the cam plate inwardly, thereby maintaining the engagement between the cam engaging projection 11*e* and the engagement projection 13*b* of any latched push button, i.e., to maintain the push button 11 in the depressed state. Reference numeral 15 denotes a cam for preventing the simultaneous locking, which is disposed on the base plate 12*b* of the leaf spring 12 and beneath the recessed portion 11*f* of the push buttons 11, and which will be turned when depressed by the push button. The cam 15 for preventing the simultaneous locking is formed roughly in a semicircular shape in cross section, and has notches 15*a* arranged alternately on each side. The notches 15*a* have a width greater than the width of the push buttons and each straddles a recessed portion 11*f* of a respective push button. Therefore, the cam 15 is able to turn in one direction when it is depressed by a push button, and will turn in the opposite direction if any adjacent push button is depressed. Reference numeral 15*b* denotes projections formed opposite respective notches 15*a*. Further, both ends of the cam 15 are fitted to semi-circular projections of the frame 17, as will be mentioned later, so that the cam 15 can rotate while being guided by the semicircular projections.

Reference numeral 16 denotes a contact having a high resiliency, which has a plurality of contact portions 16*a* formed in an inverted V-shape and corresponding to each of the push buttons 11. When a push button is depressed, the contact depressing projection 11*d* depresses the corresponding contact portion 16*a* via the hole 12*c* in the leaf spring 12, to perform the switching operation.

The frame 17 has shaft supports 17*a* for rotatably supporting the shaft portions 11*b* of the push buttons 11, a leaf spring mounting portion consisting of plate-like projections 17*b* which engage with the notches 12*d* of the leaf spring 12 and leaf spring placing portions 17*c*, a cam plate mounting portion which consists of projections 17*d* formed on the side wall of the frame and projections 17*e* that will be inserted in the holes 13*f* of the cam plate 13, and which rotatably support the cam plate 13. A contact mounting portion 17*f* for fastening the contact point 16 is also provided, as well as semicircular projections 17*g* which fit the respective ends of the cam 15 and which guide the rotation of the cam 15.

Next, the operation of the push button device of the invention will be described.

Figure 3:
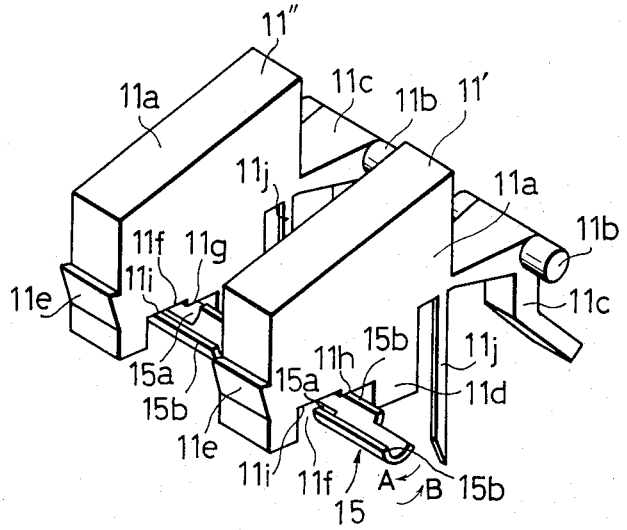
FIG. 3(*a*) and FIG. 3(*b*) are schematic views useful for explaining the operation of the push button device.
Figure 3B:
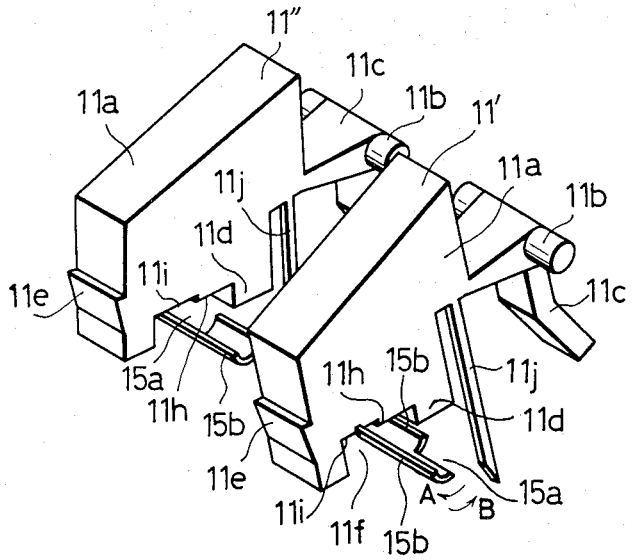

FIG. 3 is a schematic view useful for explaining the operation of the push button device, in which reference numerals 11' and 11'' denote adjacent push buttons. Here, the members same as those of FIG. 2 are denoted by the same reference numerals and their details are not illustrated. When the push button 11' fitting within a notch 15*a* formed on the left side of the cam 15 is depressed, the opposite projection 15*b* of the cam 15 is depressed by the protruded surface 11*h* of the push button 11' whereby the cam 15 starts to turn in the clockwise direction as indicated by arrow A, as the projection 15*b* starts to descend. As the push button 11' is further depressed, the cam 15 further rotates in the direction of arrow A, and the notch 15*a* bites into the operation block 11*a* (FIG. 3(*b*)). Depending upon the depressed quantity of the push button 11', on the other hand, the engagement projection 13*b* (FIG. 2) of the cam plate 13 is depressed by the cam engaging projection 11*e*, and the cam plate 13 starts to turn in the counterclockwise direction. When the push button is depressed by a predetermined stroke, the cam engaging projection 11*e* falls in the recess 13*d* and engages with the engagement projection 13*b*. Under this condition, the cam plate 13 is urged inwardly by the coil spring 14 even when the push button 11' is discontinued from being depressed. Therefore, the engagement between the cam engaging projection 11*e* and the engagement projection 13*b* is maintained, and the push button 11' is held in the depressed state.

If the push button 11'' fitting within the notch 15*a* formed on the right side of the cam 15 is then depressed, the cam plate 13 starts to turn in the counterclockwise direction, whereby the push button 11' is disengaged from the cam plate. The push button 11' is allowed to return to the non-depressed position owing to the resilient force of the spring portion 12*a* of the leaf spring 12 and, at the same time, the corresponding contact 16*a* is allowed to return to the non-depressed position.

Depending upon the depressed quantity of the push button 11'', on the other hand, the projection 15*b* of the cam 15 is depressed by a recessed surface 11*i* of the push button 11'', whereby the cam 15 starts to rotate in the counterclockwise direction as indicated by arrow B, and the projection 15*b* starts to descend. As the push button 11'' is further depressed, the cam 15 further rotates in the direction of arrow B, so that the notch 15*a* bites into the operation block 11*a*.

As the depressed quantity of the push button 11'' reaches a predetermined value, the cam engaging projection 11*e* of the push button 11'' falls in the recessed portion 13*d*, the cam plate 13 is urged inwardly by the coil spring 14, and the cam engaging projection 11*e* comes into engagement with the engagement projection 13*b*. Under this condition, even when the push button 11'' is discontinued from being depressed, the engagement between the cam engaging projection 11*e* and the engagement projection 13*b* is maintained since the cam plate 13 is urged inwardly by the coil spring, and the push button 11'' is held in the depressed state. It will be understood that the cam 15 cannot rotate when two adjacent push buttons are depressed simultaneously, and thus simultaneous locking two push buttons is prevented.

Next, the vibration-preventing mechanism for the contact will be described with reference to FIG. 4.

Figure 4A:
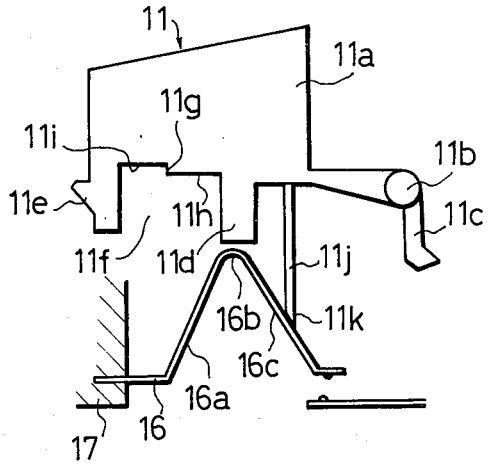
FIG. 4(*a*) and FIG. 4(*b*) are schematic views useful for explaining the relationship of positions between the contact and the push button when the push button is depressed and when the push button is locked, respectively.
Figure 4B:
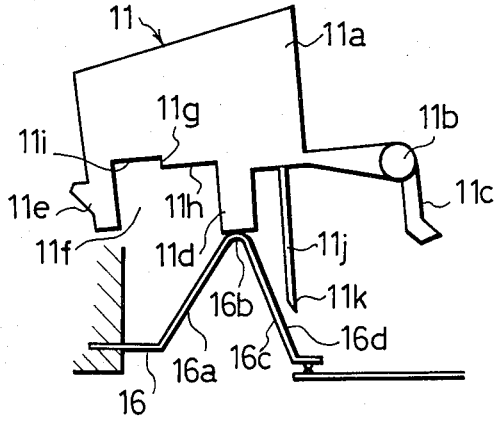

FIG. 4 is a schematic view useful for explaining the operation of the vibration-preventing mechanism for the contact wherein FIG. 4(*a*) shows the non-depressed state and FIG. 4(*b*) shows the depressed state (locked state). Like reference numerals are used for like constituent members as in FIG. 1, without their detailed explanation.

Now, when the push button 11 is depressed in a predetermined stroke as described already, another push button that has been locked is released and is allowed to return to the non-depressed position. On the other hand, at the time of locking of the depressed push button, the apex 16*b* of the contact portion 16*a* is brought into pressing contact with the contact depressing projection 11*d*, while the inclined portion 16*c* of the contact portion has a predetermined gap 16*d* with respect to the vibration-preventing projection 11*j*. Under this state, when the push button 11' starts returning to the non-depressed position, the contact portion 16*a* starts returning to its unstressed position due to its own resiliency as if it were chasing the contact depressing projection 11*d* of the push button 11. Immediately after the start of returning of the contact portion 16*a*, its inclined portion 16*c* strikes the inclined surface at the tip of the vibration-preventing projection 11*j* and is thereafter held by the vibration-preventing projection 11*j*. The contact portion 16*a* can thus raise no higher than its initial unstressed condition, as shown in FIG. 4, and, therefore, cannot vibrate. In other words, the returning force of the contact portion 16*a* due to its own resiliency is surpressed by the vibration-preventing projection 11*j* and it is thus caused to stop without vibrating.

As shown clearly in FIGS. 4(*a*) and 4(*b*), an imaginary line extending from the lowest end of the contact depressing projection 11*d* and the tip or free end of the contact 16 has an inclination generally equal to that of the inclined portion 16*c* of the contact portion. Further, the tip 11*k* of the vibration-preventing projection 11*j* has a shape substantially conforming to the inclination of the inclined portion 16*c*.

As described above, in accordance with the present invention, it is possible to easily and reliably remove the vibration of the contact having spring quality and to eliminate chattering and vibration noise by furnishing the push button with a vibration-preventing projection, such as described above.

What is claimed is:

1. In a push button switch including a plurality of push buttons having means for deflecting resilient contacts and having a spring member engaging said push buttons to urge them in a direction opposite that for deflecting the resilient contacts, the improvement including means for preventing the resilient contacts from vibrating upon release of the deflecting force from the associated push button, said means including a respective projection formed on the lower portion of said push buttons and extending towards a respective contact and dimensioned to prevent the associated contact from vibrating.

2. The vibration-preventing mechanism according to claim 1 said contacts being formed in an inverted V shape and said projection extending from the respective push button in such a manner that a line connecting the point of engagement of the push button with the respective contact to the tip of said projection is substantially equal to the inclination of said inverted V-shaped contact.

3. The vibration-preventing mechanism according to claim 2, wherein the shape of the tip of said projection is substantially equal to the inclination of said inverted V-shaped contact.

* * * * *